US005591176A

United States Patent [19]

Henderson et al.

[11] Patent Number: 5,591,176

[45] Date of Patent: Jan. 7, 1997

[54] METHOD AND APPARATUS FOR LIVESTOCK CASTRATION

[75] Inventors: Lance S. Henderson, Edwards; Randall C. Parks, Independence, both of Mo.

[73] Assignee: Stone Manufacturing & Supply Co., Inc., Kansas City, Mo.

[21] Appl. No.: 346,481

[22] Filed: Nov. 29, 1994

[51] Int. Cl.[6] ..... A61D 1/06

[52] U.S. Cl. ..... 606/137; 606/207; 606/208; 606/205; 81/318; 81/319

[58] Field of Search ..... 606/137, 138, 606/151, 157, 163, 164, 136, 116, 117, 205, 206, 207; 81/318, 319, 322, 323, DIG. 1, 487, 180.1, 627.5

[56] References Cited

U.S. PATENT DOCUMENTS

| | | | |
|---|---|---|---|
| 405,642 | 6/1889 | Woodie | 606/136 |
| 672,997 | 4/1901 | Wootan | 606/137 |
| 1,375,456 | 4/1921 | Hasty | 81/53.2 |
| 2,086,863 | 7/1937 | Geddes | 81/427.5 |
| 5,188,636 | 2/1993 | Fedotov | 606/139 |
| 5,423,855 | 6/1995 | Marienne | 606/206 |

*Primary Examiner*—Robert A. Hafer
*Assistant Examiner*—Justine Yu
*Attorney, Agent, or Firm*—Shook, Hardy & Bacon L.L.P.

[57] ABSTRACT

A clamp is provided for castrating livestock. The clamp includes a pair of opposed elongated members, each having a curved jaw and a handle. The members are pivotally coupled so that the clamp may be moved between a released position with the jaws spaced apart and a clamped position with the jaws spaced apart slightly. The clamp also includes a locking mechanism so that the jaws can be locked in the clamped position. At least one of the members includes a shank for engagement with the chuck of a power rotary device such as a drill. The clamp is used to rapidly twist the spermatic cord to cause it to break and form a knot which reduces bleeding from the cord.

13 Claims, 1 Drawing Sheet

METHOD AND APPARATUS FOR LIVESTOCK CASTRATION

BACKGROUND OF THE INVENTION

This invention relates to the castration of livestock and, more specifically, to a selectively lockable clamp and method for castrating livestock.

Castration is a term used to describe the removal of an animal's testes. Removal of the testes eliminates the production of spermatozoa as well as the animal's chief source of testosterone. Castration is routinely performed on livestock and, particularly, livestock bred for human consumption.

There are several methods of castration. Perhaps the most common method is a surgical procedure which entails the physical removal of the testes with emasculators. This procedure requires that the scrotum of the animal be incised to expose the testes and spermatic cords. The emasculator is then used to sever the spermatic cords, thereby removing the testes.

The main advantage of this procedure lies in its effectiveness in that the testes are physically removed from the animal. The primary disadvantage of the procedure involves the bleeding and likelihood of infection brought about by severing the spermatic cords. Sutures are rarely employed in connection with this procedure and, therefore, the severed cords often bleed significantly. In addition, the severed cords are left relatively open to bacterial migration and occasionally become infected, thereby necessitating subsequent remedial procedures.

Another method of castration involves the use of pinchers to crush the spermatic cords from outside the scrotum. This method, known commonly as the Burdizzo procedure, does not involve surgically invasive measures, such as cutting the scrotum or the spermatic cords, but requires only external manipulation. The crushed cords inhibit blood flow to the testes which subsequently atrophy inside the scrotum.

Principal advantages of this method are the reduced bleeding and the reduced likelihood of infection. One disadvantage with this method is that it is occasionally ineffective. Unless the spermatic cords are sufficiently crushed, the testes may subsist and remain productive. Another disadvantage of this procedure lies in the difficulty of its performance. This procedure requires that the spermatic cords be located and isolated from outside the scrotum so that the pincer can be applied. This is a dexterous exercise which can be very difficult to perform in the field.

Yet another common procedure for castration involves the use of elastrator rings. Elastrator rings are highly elastic rubber rings that are placed over the scrotum of the animal above the testes. The elastrator ring prohibits blood flow to the testes which causes them to atrophy.

As with the pincer method, the main advantage with this procedure is the reduced bleeding and likelihood of infection. A serious drawback with use of elastrator rings, however, is that the efficacy of the procedure may be compromised if the ring is not properly positioned on the scrotum above both testes. Moreover, even if properly positioned, the ring does not always sufficiently reduce blood flow to the testes to bring about atrophy. In addition, the proper employment of elastrator rings is made difficult in the field due to the precise nature of use.

It is, therefore, an object of the present invention to provide a device and procedure for castrating livestock that afford the efficacy of surgical removal of the testes while substantially eliminating the incidence of excessive bleeding and reducing the likelihood of infection as with non-surgical procedures.

More particularly, it is an object of the present invention to provide a device and procedure for castration whereby the testes are physically removed at the spermatic cords with reduced bleeding and with a mitigated likelihood of infection.

It is a further object of the present invention to provide a selectively lockable clamp adapted for closure on the spermatic cord so that the clamp may be mechanically rotated thereby twisting the spermatic cord and breaking it.

It is a still a further object of the present invention to provide a novel lockable clamp adapted to be operated by a power rotary device, such as an electric drill, so that the clamp may be rotated rapidly to effect castration in a manner to substantially eliminate bleeding and minimize the likelihood of subsequent infection.

SUMMARY OF THE INVENTION

To accomplish the foregoing and other related objects, the present invention relates to a device and method for castrating livestock. In its preferred embodiment, the device of the present invention comprises a clamp having a pair of opposed elongated members, each having a curved jaw and a handle. The members are pivotally coupled so that the clamp may be selectively moved from an open position, wherein the jaws are spaced apart, and a closed position, wherein the jaws are maintained in close spatial proximity. The clamp includes a locking mechanism whereby the clamp can be selectively locked in the closed position. The handle of at least one of the members is adapted to be coupled with a portable power rotary device, preferably a variable speed, cordless power drill.

In operation, the scrotum of the animal is incised using a cutting instrument and, preferably, a Newberry knife. The testes are pulled away from the scrotum and the scrotum is pushed upwardly to allow unobstructed access to the spermatic cords. The clamp of the present invention is then positioned over preferably one but permissibly both spermatic cords and locked in the closed position. The rotary drill is then activated thereby rotating the clamp and causing the spermatic cord to twist. After sufficient twisting, the cord breaks and the testis is removed. The process is then repeated with respect to the second testis. After the second testis is removed, the scrotum region may be sprayed with an antibacterial agent to inhibit subsequent infection. The power device provides the twisting action which renders the process practical.

BRIEF DESCRIPTION OF THE DRAWINGS

The accompanying drawings form part of and are to be read in conjunction with the specification. Numbers have been used in the drawings to indicate features and parts of the various views that are discussed in the specification. The views in the drawings are as follows.

DESCRIPTION OF THE PREFERRED EMBODIMENT

Figures 1, 2, 3, 4, 5, 6:
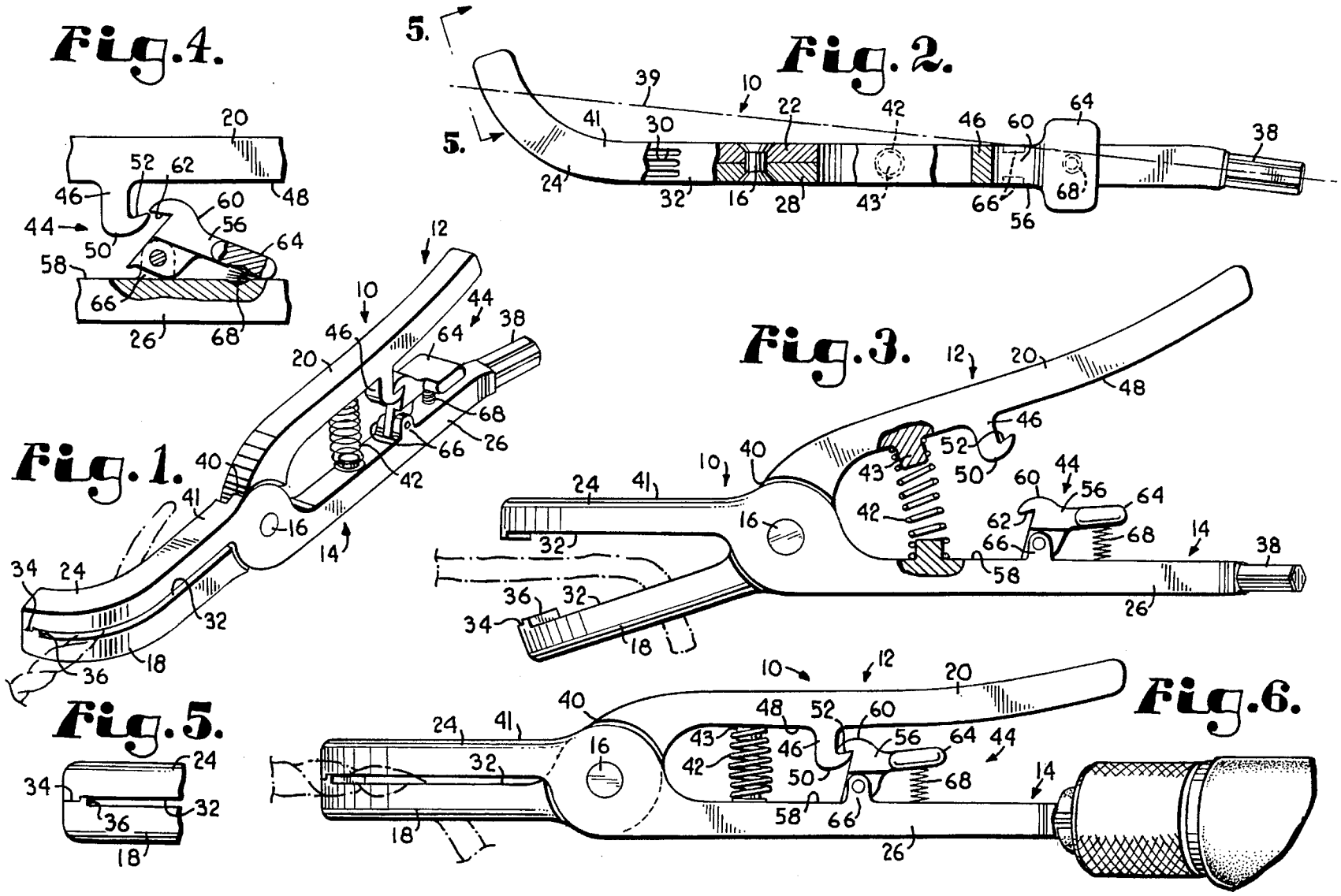
FIG. 1 is a perspective view of the castrating clamp of the present invention.
FIG. 2 is a top elevational view of the castrating clamp of FIG. 1 with portions broken away for illustration purposes and showing the curved jaw region of the clamp.
FIG. 3 is a side elevational view of the castrating clamp of the present invention showing the clamp in open position with the jaw regions spaced apart over a spermatic cord, shown fragmentally in phantom lines.
FIG. 4 is an enlarged fragmentary view of the locking mechanism of the clamp showing the spring-loaded latch forced rearwardly to an inclined position by the downwardly compressed hook, parts being broken away and shown in cross section to reveal details of construction.
FIG. 5 is an enlarged fragmentary view of the front portion of the jaws of the clamp and illustrating the projections in engaged position, thereby allowing the rear portions of the jaws to be maintained in close spatial proximity.
FIG. 6 is a side elevational view of the castration clamp of the present invention showing the device locked in closed position and secured to a rotary drill, shown fragmentally, and illustrating a spermatic cord, which is shown fragmentally in phantom lines, wrapped around the locked jaws of the device in response to rotation of the clamp by the drill.

Turning now to the drawings, the castrating clamp of the present invention is broadly designated by the numeral 10. Clamp 10 comprises a first elongated bar 12 and a second elongated bar 14. For purposes of ease of construction, bars 12 and 14 have a generally rectangular cross section, but may also be other shapes if desired. Bars 12 and 14 are preferably constructed of stainless steel, but may be formed of any suitable rigid material that can withstand repeated sterilization and use. First bar 12 includes a lower jaw 18 and an upper handle 20 separated by a first coupling region 22, seen best in FIG. 2. Conversely, second bar 14 includes an upper jaw 24 and a lower handle 26 separated by a second coupling region 28.

Bars 12 and 14 are pivotally connected by a coupler 16 at their respective coupling regions 22 and 28 for relative pivotal movement between an open position, wherein the jaws 18 and 24 are spaced apart to receive a spermatic cord as in FIG. 3, and a closed position, wherein jaws 18 and 24 are maintained in close spatial proximity as in FIG. 1. Coupler 16 preferably comprises a stainless steel flat head rivet, but might also comprise any other coupling means capable of allowing relative pivotal movement of bars 12 and 14.

Lower jaw 18 and upper jaw 24 should be at least two inches and preferably approximately three and one fourth inches in length. Jaws 18 and 24 are preferably curved in the same direction away from the longitudinal axis of the clamp 10 as shown in the drawings. Most preferably, the extent of curvature of jaws 18 and 24 is approximately 45 degrees, measured as the extreme outer tangent of the jaws 18 and 24 relative to the longitudinal axis of the clamp 10. In addition, jaws 18 and 24 preferably curve on a plane perpendicular to the plane of pivotal movement of the clamp 10. The curvature of jaws 18 and 24 allows the clamp 10 to be more conveniently deployed and attached to the spermatic cords. The curved jaws 18 also allow better alignment of the clamp 10 when the clamp is rotated. While the above preferred curvature of jaws 18 and 24 has been found most advantageous, other embodiments having varying degrees and orientations of curvature may also prove workable and are, thus, within the ambit of the present invention.

Longitudinal grooves 30 are defined on the inner, facing surfaces 32 of jaws 18 and 24. Grooves 30 increase the effective coefficient of friction between the jaws 18 and 24 and the membranous tissue surrounding the spermatic cord, thereby reducing slippage of the cords from clamp 10.

Jaws 18 and 24 each have an inwardly extending projection 34. The projections 34 on the respective jaws are mutually opposed and, preferably, integrally formed with jaws 18 and 24, but may be affixed by any other suitable means. As best shown in FIG. 5, each projection 34 juts from the inner surface 32 at the end of its corresponding jaw and are in complemental engagement when the clamp 10 is in closed position. In the preferred embodiment, projections 34 include at least one shoulder 36 which is adapted to complementarily engage the opposing projection 34. Projections 34 function to maintain jaws 18 and 24 in close spatial relationship when the clamp 10 is in the closed position while preventing the jaws from coming into contact, which could prematurely sever the spermatic cord. In addition, the engaged projections 34 create an enclosed area between jaws 18 and 24 wherein the spermatic cord is contained during the procedure. The engaged projections 34 should be constructed so that they will maintain a space between jaws 18 and 24 of at least about 1/16 to a maximum of about 3/8 inch in width. Preferably, the space should be about 3/32 inch.

Handles 20 and 26 are formed to allow easy manipulation of clamp 10 by the user. To this end, upper handle 20 is preferably slightly curved to fit the contour of the palm. The rear portion of upper handle 20 is also somewhat upturned to provide more ready access to the locking mechanism, discussed below. Lower handle 26 is preferably straight to promote more linear rotation of clamp 10.

Turning now more closely to FIG. 2, the end of handle 26 includes a shank 38 adapted to be secured to a power rotary device. Shank 38 preferably has a polygonal cross section so that a more secure attachment to the rotary device may be achieved. In the preferred embodiment, shank 38 is offset from the longitudinal axis of handle 26. Most preferably, the shank 38 is angled from handle 26 so that the longitudinal axis 39 of shank 38 projects through the approximate center of jaws 18 and 24. The angled disposition of shank 38 causes the spermatic cord secured between jaws 18 and 24 to twist about the approximate axis of rotation of the rotary device. In addition, the offset shank 38 reduces the lateral profile of the clamp 10 as it is deployed, thereby making the device easier to use. It is to be understood, though, that a shank 38 disposed co-linear to handle 26 is anticipated by the present invention and is, thus, within its scope.

Coupler 16 pivotally connects bars 12 and 14 at their respective coupling regions, 22 and 28. Coupler 16, and hence coupling regions 22 and 28, are preferably located intermediate the ends of the bars 12 and 14 relatively near jaws 18 and 24. This positioning allows for a greater mechanical advantage to be achieved at the jaws 18 and 24 by applying force to handles 20 and 26.

In the preferred embodiment, coupling regions 22 and 28 are in the form of reciprocal grooves having generally curved sides. Coupling regions 22 and 28 extend into bars 12 and 14 approximately one-half their lateral width so that when coupled, as in FIG. 2, the width of clamp 10 at coupler 16 is approximately equal to the width of individual bars 12 and 14. Coupling regions 22 and 28 act in concert with coupler 16 to ensure a more secure joinder of bars 12 and 14. In addition, because coupling regions 22 and 28 fit in a reciprocally engaging manner, they promote more linear pivotal movement of clamp 10. Finally, the preferred construction of coupling regions 22 and 28 operates as a stop to limit the extent of pivotal movement of the clamp 10. As illustrated in FIG. 3, the corners 40 formed by coupling regions 22 and 28 limit movement of the clamp 10 when contacted by the outer surfaces 41 of jaws 18 and 24.

A spring is preferably utilized in the present invention to apply limited force to the clamp 10 biasing it to the open position. In the preferred form, this comprises a helical compression spring 42 mounted between the handles 20 and 26. The biasing force applied by spring 42 should be sufficient to normally maintain clamp 10 in its open position but should allow a user to close the clamp with little exertion. The spring 42 is mounted to handles 20 and 26 by any suitable means, such as by integrally formed rivets 43.

A locking mechanism is provided to selectively and releasably lock clamp 10 in the closed position. In the preferred form, the locking means comprises a butterfly latch mechanism, broadly designated by the numeral 44. The hook 46 of mechanism 44 is disposed on the inner surface 48 of upper handle 20. Hook 46 is preferably integrally formed to handle 20, but may also be affixed by any suitable means. Hook 46 includes a concave outer surface 50 and a lip 52 formed by the rear edge of surface 50.

The latch 56 of mechanism 44 is disposed on the inner surface 58 of handle 26 at a position to engage hook 46 to lock clamp 10 in closed position. Latch 56 also has a convex outer surface 60 which forms a catch 62 at its forward edge. A relatively flat depressor 64 is formed by the rear of latch 56. The width of depressor is greater than the width of handles 20 or 26 to allow easier manual manipulation by a user. Latch 56 is pivotally mounted to a base 66 which allows latch 56 to rock between an upright position and an inclined position. Base 66 is preferably integrally formed with handle 26, but may also be affixed by any suitable means. A spring 68 is mounted between surface 58 and bottom of depressor 64 to urge latch to the upright position.

Hook 46 and latch 56 are positioned so that curved surfaces 50 and 60 contact as the clamp 10 is moved toward the closed position, thereby forcing latch 56 rearwardly to the inclined position. As the rear edge of surface 50 passes below the front edge of surface 60, spring 68 forces latch forward to the upright position, thereby engaging catch 62 into lip 52 in releasably secure fashion. To disengage the mechanism 44, force is applied to depressor 64 which rocks latch 56 to inclined position. Spring 42 then forces hook 46 away from latch 56 and returns clamp 10 to the open position.

The clamp of the present invention may be used to castrate all livestock and is perhaps most useful for the castration of bull calves. The method of castration using the clamp of the present invention is as follows:

The procedure for carrying out the present invention employs a power rotary source coupled with the clamp. Any means for applying torque of at least 25 in./lb. may be used as the power rotary source. Preferably, the device should be portable and cordless to allow more convenient use. Most preferably, the device comprises a cordless power drill. To secure the clamp to a drill of this type, the shank is inserted and tightened within the chuck of the drill.

The animal is then immobilized in a manner which provides access to the scrotum region. After administration of the appropriate anesthesia, the scrotum region of the animal is treated with a suitable topical disinfectant. Preferably, a liquid antibacterial agent is applied to the scrotum and surrounding area of the animal.

An incision is then made in the scrotum. Any sterile instrument capable of making an incision may be used, but it is preferable that a Newberry knife be employed. A Newberry knife is widely used in castrating livestock and comprises a clamp having a sharp edge projecting inwardly from one jaw of the clamp. The Newberry knife is inserted through the scrotum above the testes and then pulled downwardly to create an incision essentially bisecting the scrotum through the extreme ventral portion. An incision of this nature ensures appropriate drainage of fluids after the procedure is performed.

Once the incision is made, the testes are pulled away from the scrotum and the scrotum pushed upwardly to allow substantially unobstructed access to the spermatic cords of the animal. The spermatic cords are contained within membranous vaginal tunics which also extend over the individual testis. It is not necessary to remove the vaginal tunic from around the spermatic cord to perform the instant procedure.

The jaws of the clamp are placed around the spermatic cord at a position just below the retracted scrotum. It is important that the longitudinal axis of the chuck of the drill be generally aligned with the spermatic cord. This alignment is advantageous because it allows the cord to rotate on approximately the same axis of rotation as that of the drill, thereby improving the usefulness of the clamp. After the jaws of the clamp are in place, the clamp is locked in the closed position on the cord. In proper placement, the rear portions of the jaws should be locked over the spermatic cord with the projections adjacent the cord.

The power rotary device is activated after the jaws of the clamp are locked in proper position. The activated drill causes the clamp to spin thereby repeatedly twisting the spermatic cord. After sufficient twisting, the spermatic cord will break forming a knot-like formation with the cord and the tunic tissue. The power rotary device is deactivated after the cord breaks. The clamp is then unlocked by pressing the depressor on the latch and the spring bias causes the clamp to open, thereby releasing the severed testis. The procedure is then repeated with respect to the second testis.

After the testes have been removed, the scrotum region may be disinfected by application of a suitable antibacterial agent. The animal is then released from immobilization.

Castration using the present invention provides the benefits of existing procedures in the art without the associated drawbacks. The means of testis removal of the present invention promotes a knotting effect in the spermatic cord and vaginal tunic, thereby eliminating the risk of excessive bleeding. This knotting effect also inhibits the likelihood of infection because infectious agents are prohibited access to the interior of the spermatic cord or vaginal tunic surrounding the cord. Because the testes are removed, the reduced bleeding and mitigated likelihood of infection are not achieved at the expense of efficacy.

From the foregoing, it will be seen that this invention is one well-adapted to attain all the objectives set forth above together with other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the present invention without departing from its scope, it is to be understood that all matters set forth herein and shown in the accompanying drawings are to be interpreted as illustrative only and not in a limiting sense.

The following is claimed:

1. A selectively lockable clamp for castrating livestock by twisting the spermatic cords until said cords break as a result of said twisting, said clamp comprising:

a pair of elongated, rigid members each having a longitudinal axis and opposed ends, said members being pivotally interconnected between their ends to present a pair of jaws and a pair of handles, said jaws being curved from the longitudinal axes of said members and adapted to be manipulated by the handles between a clamped position with opposed facing surfaces of the jaws grasping a spermatic cord and a released position allowing removal of said spermatic cord, said opposed facing surfaces of the jaws being spaced apart a preselected distance when the jaws are in said clamped position to prevent severing of the spermatic cord by said opposed facing surfaces;

a latch carried by said members for holding the jaws in said clamped position grasping said spermatic cord, said latch being selectively manually operable to release the jaws from the clamped position to allow the jaws to be moved to the released position to allow removal of said spermatic cord; and means on one of said handles for coupling said one handle with a source of torque for rotating the clamp to twist and break the spermatic cord when the jaws are in said clamped position with said spermatic cord grasped between said opposed facing surfaces of the jaws.

2. The clamp of claim 1 further comprising a means for applying limited force to said members to bias said jaws apart.

3. The castration clamp of claim 2 wherein said biasing means includes a spring mounted between said handles.

4. The castration clamp of claim 3 wherein said latch comprises a latch-hook mechanism including a hook mounted to one of said handles and a spring-loaded latch mounted to the other of said handles, said latch being disposed to releasably engage said hook when the jaws are in said clamped position.

5. The castration clamp of claim 4 wherein said jaws curve outwardly from the longitudinal axis of said members on a plane substantially perpendicular to the plane of pivotal movement of the members.

6. The castration clamp of claim 5 wherein said coupling means comprises a shank having a polygonal cross section.

7. The castration clamp of claim 6 wherein said shank is angled from the longitudinal axis of said handle so that the axis of the shank projects through said jaws.

8. The castration clamp of claim 1 including a projection on one of said jaws and engageable with the other of said jaws when the jaws are in said clamped position to maintain said opposed facing surfaces apart said preselected distance.

9. The castration clamp of claim 8 wherein said projection is positioned on one of said opposed facing surfaces at a distal end of one of said jaws and engages the other of said opposed facing surfaces when the jaws are in said clamped position.

10. The castration clamp of claim 1 wherein said preselected distance is between approximately 1/16 inch to approximately 3/8 inch.

11. A cordless power drill in combination with said castration clamp of claim 7, said drill being coupled with said shank and operable to rotate the clamp about the axis of the shank.

12. A selectively lockable clamp for castrating livestock by twisting the spermatic cords until said cords break as a result of said twisting, said clamp comprising:

a pair of elongated, rigid members each having a longitudinal axis and opposed ends, said members being pivotally interconnected between their ends to present a pair of jaws and a pair of handles, said jaws being curved from the longitudinal axes of said members and adapted to be manipulated by the handles between a clamped position with opposed facing surfaces of the jaws grasping a spermatic cord and a released position allowing removal of said spermatic cord;

a projection carried on one of said jaws and engageable with the other of said jaws when the jaws are in said clamped position to maintain said opposed facing surfaces of the jaws apart a preselected distance to prevent severing of the spermatic cord by said opposed facing surfaces when the jaws are in said clamped position;

a latch carried by said members for holding the jaws in said clamped position grasping said spermatic cord, said latch being selectively manually operable to release the jaws from the clamped position to allow release of said spermatic cord; and a shank on one of said handles for coupling said one handle with a source of torque for rotating the clamp to twist and break the spermatic cord when the jaws are in said clamped position with said spermatic cord gasped between said opposed facing surfaces of the jaws.

13. The castration clamp of claim 12 wherein said preselected distance is between approximately 1/16 inch to approximately 3/8 inch.

* * * * *